US007175032B2

(12) United States Patent
Ling

(10) Patent No.: US 7,175,032 B2
(45) Date of Patent: Feb. 13, 2007

(54) TOOL RACK ASSEMBLY

(75) Inventor: David Ling, Taichung (TW)

(73) Assignee: Easco Hand Tools, Inc., Simsbury, CT (US)

( * ) Notice: Subject to any disclaimer, the term of this patent is extended or adjusted under 35 U.S.C. 154(b) by 0 days.

(21) Appl. No.: 11/158,417

(22) Filed: Jun. 22, 2005

(65) Prior Publication Data

US 2005/0274683 A1 Dec. 15, 2005

Related U.S. Application Data

(63) Continuation of application No. 10/752,236, filed on Jan. 6, 2004, now abandoned, which is a continuation of application No. 09/906,525, filed on Jul. 16, 2001, now Pat. No. 6,712,224.

(51) Int. Cl.
*A47F 7/00* (2006.01)

(52) U.S. Cl. ..... 211/70.6

(58) Field of Classification Search ..... 211/70.6, 211/87.01; 206/376, 377, 378
See application file for complete search history.

(56) References Cited

U.S. PATENT DOCUMENTS

| | | | | |
|---|---|---|---|---|
| 992,203 | A | 5/1911 | Johnson | |
| 2,805,777 | A | 9/1957 | Larson | 211/60 |
| 5,036,975 | A | 8/1991 | Chow | 206/376 |
| D343,976 | S | 2/1994 | Chow | D6/571 |
| D352,219 | S | 11/1994 | Chow | D8/71 |
| D355,826 | S | 2/1995 | Chow | D8/71 |
| D365,681 | S | 1/1996 | Chow | D3/315 |
| 5,598,924 | A | 2/1997 | McCann | 206/372 |
| 5,730,303 | A | 3/1998 | Chow | 211/70.6 |
| 5,893,542 | A | 4/1999 | Hu | 248/176.1 |
| D409,906 | S | 5/1999 | Hu | D9/415 |
| 5,899,329 | A | 5/1999 | Hu et al. | 206/376 |
| D412,844 | S | 8/1999 | Kopala, Jr. | D9/415 |
| 5,941,386 | A | 8/1999 | Hu et al. | 206/376 |
| 5,988,381 | A | 11/1999 | Ling | 206/349 |
| 6,039,188 | A | 3/2000 | Lee | 206/758 |
| D426,151 | S | 6/2000 | Ling | D9/415 |
| D430,799 | S | 9/2000 | Ling | D9/415 |
| 6,126,004 | A | 10/2000 | Ling | 206/377 |
| RE37,129 | E | 4/2001 | Chow | 206/349 |
| 6,257,409 | B1 * | 7/2001 | Lin | 206/376 |
| 6,360,892 | B1 | 3/2002 | Chen | 206/376 |
| 6,375,005 | B1 | 4/2002 | McCann | 206/349 |
| 6,401,923 | B1 | 6/2002 | Huang | 206/376 |
| 6,409,015 | B1 | 6/2002 | Hu | 206/378 |
| 6,464,840 | B1 | 10/2002 | McCann | 203/349 |
| 6,523,687 | B2 | 2/2003 | Ling | 206/378 |
| 6,536,611 | B2 * | 3/2003 | Chen | 211/70.6 |
| 6,712,224 | B2 * | 3/2004 | Ling | 211/70.6 |
| 6,857,527 | B2 | 2/2005 | Hu | 211/70.6 |
| 2003/0080076 | A1 * | 5/2003 | Hu | 211/70.6 |

* cited by examiner

*Primary Examiner*—Sarah Purol
(74) *Attorney, Agent, or Firm*—Nelson Mullins Riley & Scarborough, LLP

(57) ABSTRACT

A tool rack assembly comprises a board and a tool rack detachably mounted to the board. In another embodiment, a tool try-on device is provided comprises a board and a rotating member rotatably mounted to the board. The rotating member is engageable with an end of a tool. The rotating member moves in a direction transverse to a plane on which the board lies when the tool engaged with the rotating member is turned.

8 Claims, 9 Drawing Sheets

A-A

B-B

C-C

TOOL RACK ASSEMBLY

CLAIM OF PRIORITY

The present application is a continuation of U.S. patent application Ser. No. 10/752,236, filed Jan. 6, 2004 now abandoned, which is a continuation of U.S. patent application Ser. No. 09/906,525, filed Jul. 16, 2001 now U.S. Pat. No. 6,712,224, the entire disclosure of which is hereby being incorporated by reference in its entirety.

BACKGROUND OF THE INVENTION

1. Field of the Invention

The present invention relates to a tool rack assembly. In particular, the present invention relates to a tool rack assembly comprising a board and a tool rack releasably attached to the board. The present invention also relates to a tool try-on device allowing try-on of a tool.

2. Description of the Related Art

A conventional tool pack, when holding a multiplicity of tools of different kinds and sizes, occupies a considerable space and is bulky and thus inconvenient to carriage and storage. Management of the tools may be a problem in some cases. Some of the tool racks provide a try-on function allowing the customer to try on the tool before buying it. However, the rotating member on the tool rack rotates freely, which is unlike transverse movement of that in real operation.

SUMMARY OF THE INVENTION

An object of the present invention is to provide a tool rack assembly comprising a board and a tool rack releasably attached to the board. The board serves as a display device when the tool rack having tools mounted thereon is attached thereto. Thus, the user may select the required tools and place them on the tool rack, which, in turn, can be releasably attached to the board conveniently. The tool rack is tied up to the board during display, thereby preventing theft. The tool rack can be detached from the board and thus be used separately. In addition, one may try on the tool before buying it, and the operation is imitating the real operation by allowing a rotating member rotatably mounted to the board to move along a transverse direction during operation of the tool.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
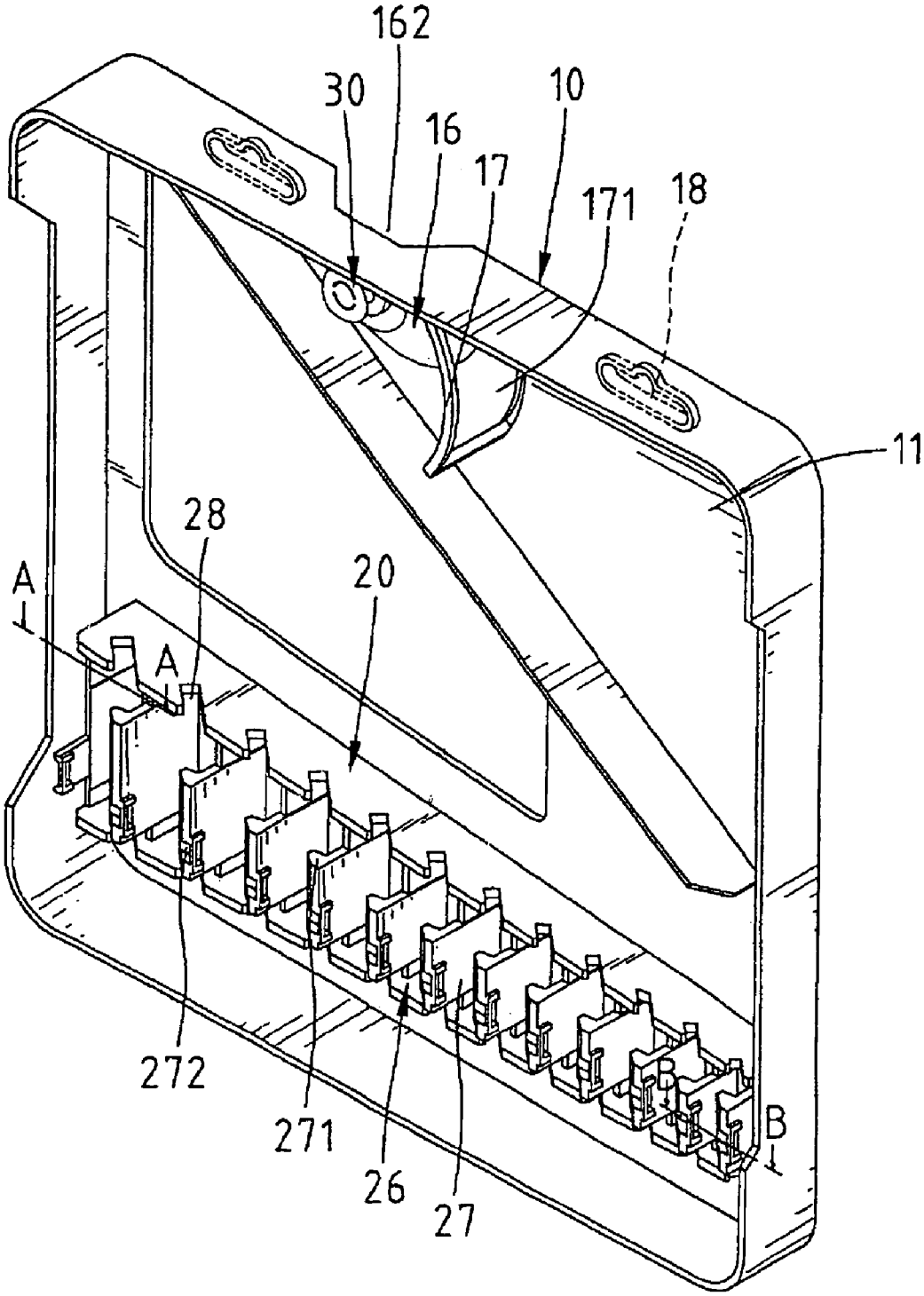
FIG. 1 is a perspective view of a tool rack assembly in accordance with the present invention.
Figure 2:
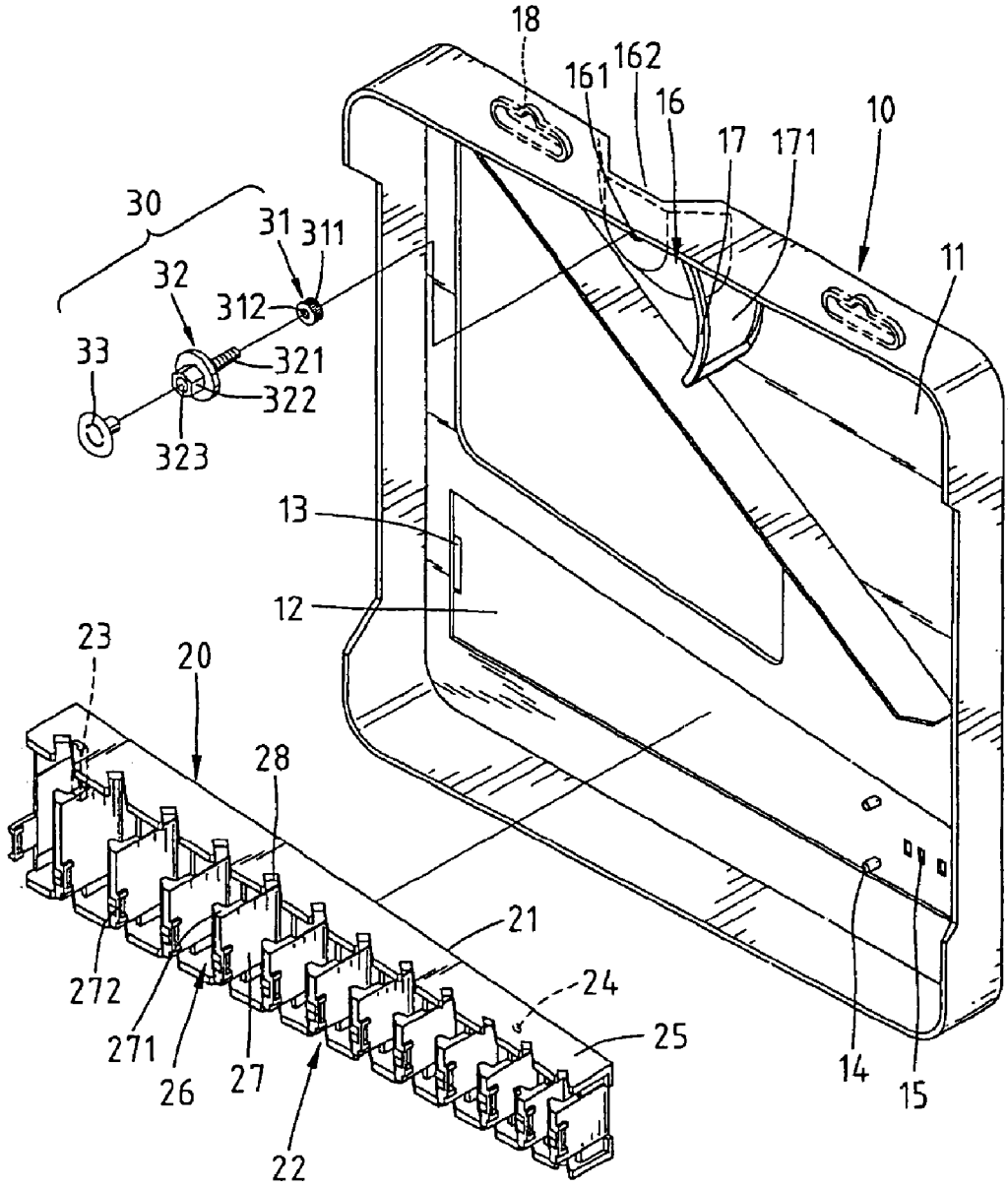
FIG. 2 is an exploded perspective view of the tool rack assembly in accordance with the present invention.

Referring to FIGS. 1 and 2, a tool rack assembly in accordance with the present invention generally includes a board 10 and a tool rack 20 releasably attached to the board 10. The board 10 includes a tool rack compartment 12 having a slot 13 on an end thereof and two pegs 14 as well as a plurality of openings 15 on the other end thereof. The board 10 further comprises a hanging hole 18 so as to allow hanging of the board 10 to a wall. The board 10 further comprises a try-on space 11 in which a bulge 16 is defined. A recess 162 may be defined in a rear side of the board 10 and behind the bulge 16. A rotating means 30 may be provided on the bulge 161 on the board 10 to allow a potential customer to try on the tools held on the tool rack 20. A restraining frame 17 with an opening 171 is provided in the try-on space 11 of the board 10 to limit rotational movement of a wrench to be tried on, which will be described later.

Figure 5:
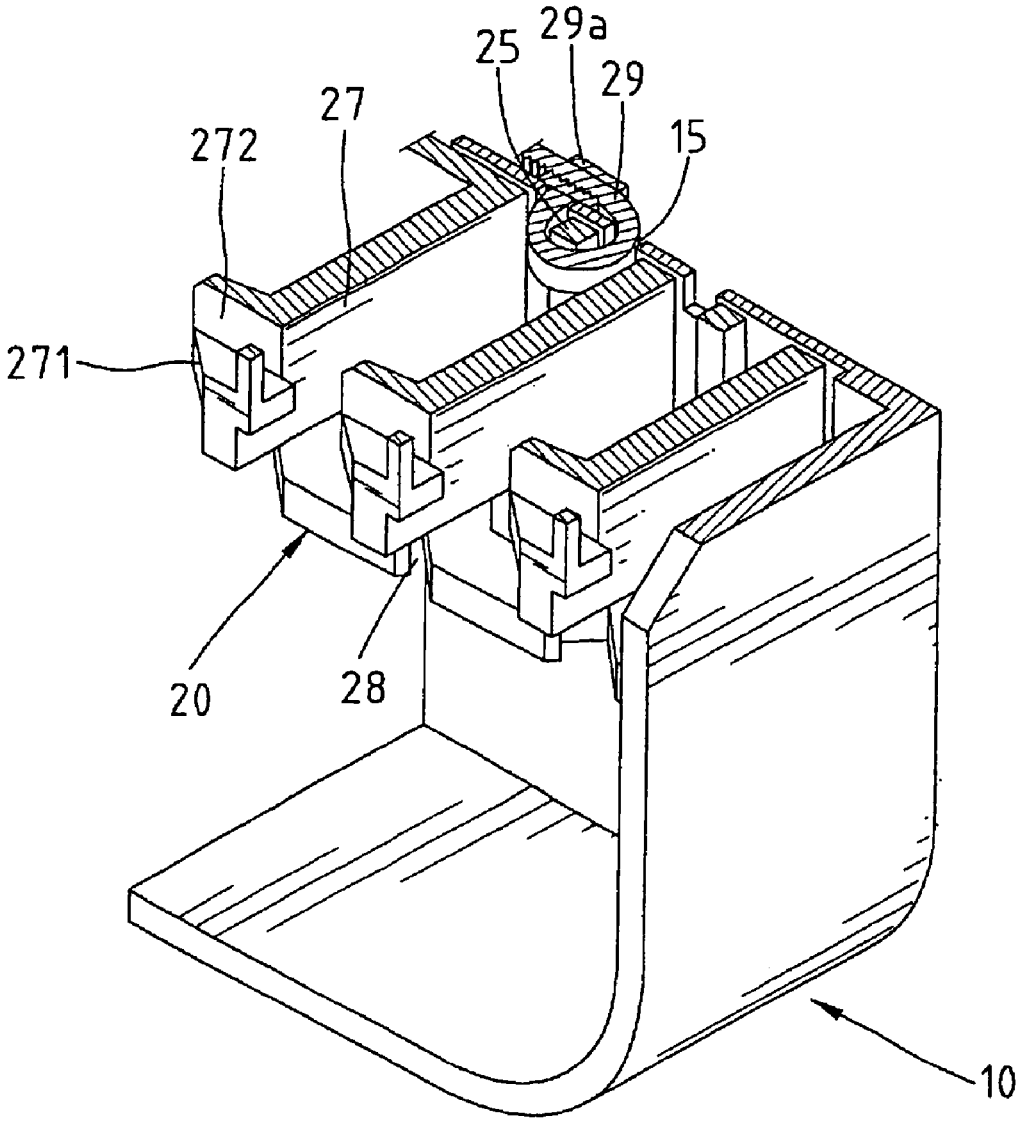
FIG. 5 is a perspective view illustrating a portion of the tool rack assembly and sectioned along plane B—B in FIG. 1.

The tool rack 20 comprises a fist side 21 and a second side 22 that is opposite to the first side 21. An engaging hook 23 is provided on an end of the first side 21 for releasably engaging with the slot 13 of the tool rack compartment 12. Two holes 24 are defined in the other end of the first side 21 for releasably engaging with the pegs 14 of the tool rack compartment 12. After the tool rack 20 is mounted in the tool rack compartment 12, a tying strip 25 is used to tie up the former to the latter. As illustrated in FIG. 5, a flexible enlarged end 29*a* of the tying strip 29 outside the board 10 is passed through one of the openings 15 in the board 10, wound around a rib 25 formed on the tool rack 20, and passed through another opening 15 in the board 10 and a tightening hole in the tying strip 29. Thus, the tool rack 20 is fixedly tied up to the board 10. Removal of the tool rack 20 is allowed only when the tying strip 29 is severed.

Figure 3:
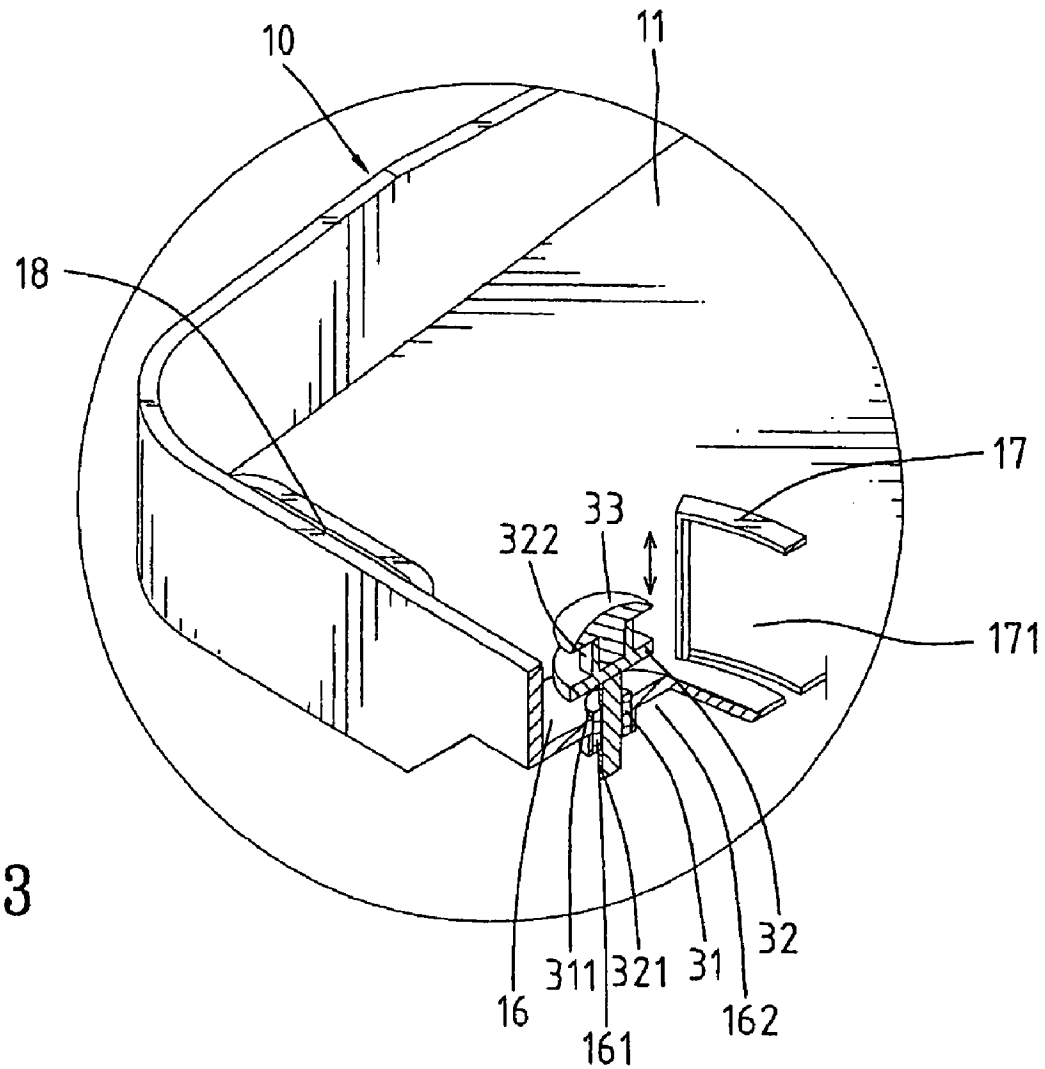
FIG. 3 is an enlarged perspective view of a rotating means mounted on the tool rack assembly in accordance with the present invention.
Figure 4:
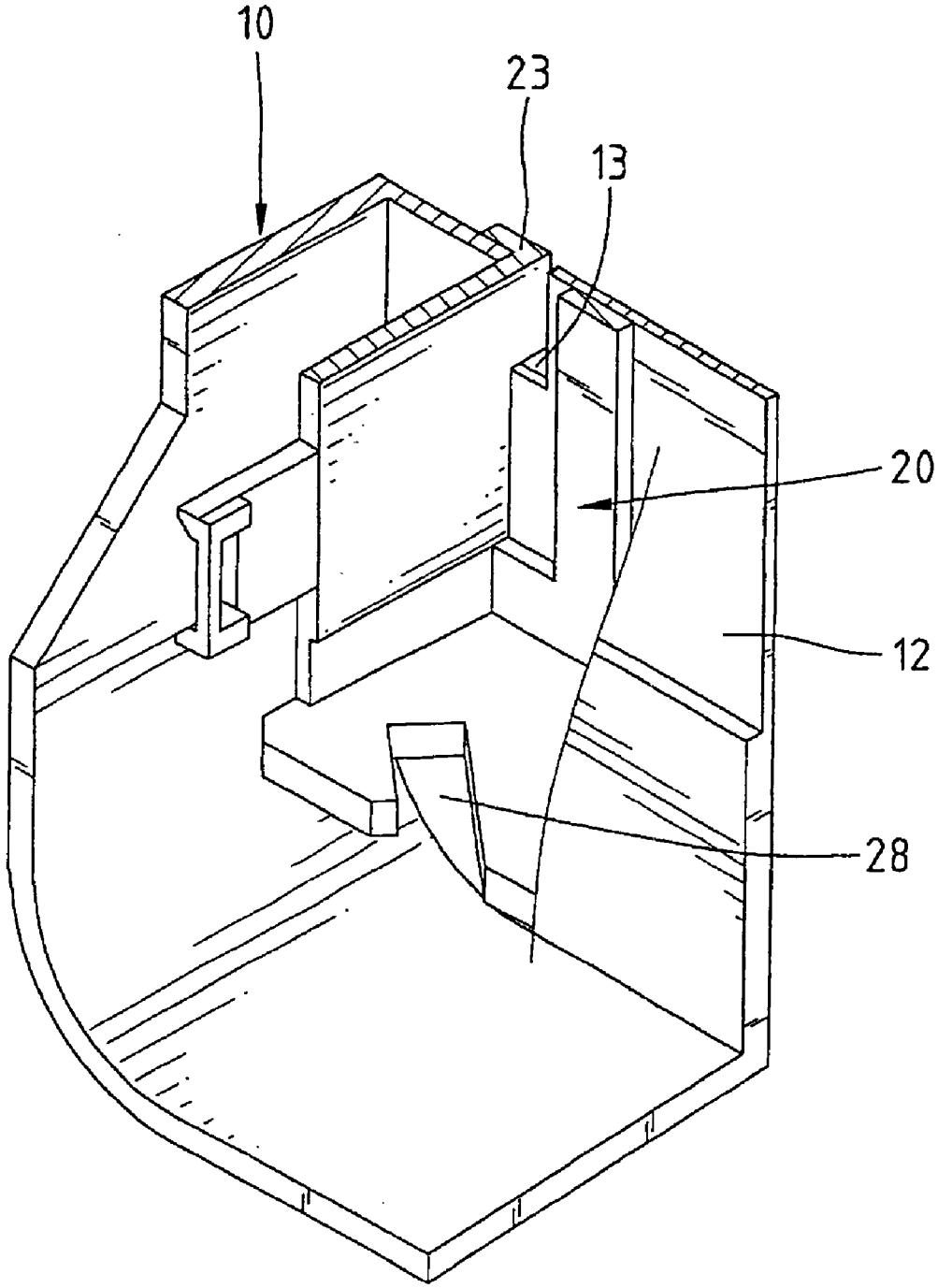
FIG. 4 is a perspective view illustrating a portion of the tool rack assembly and sectioned along plane A—A in FIG. 1.
Figure 6:
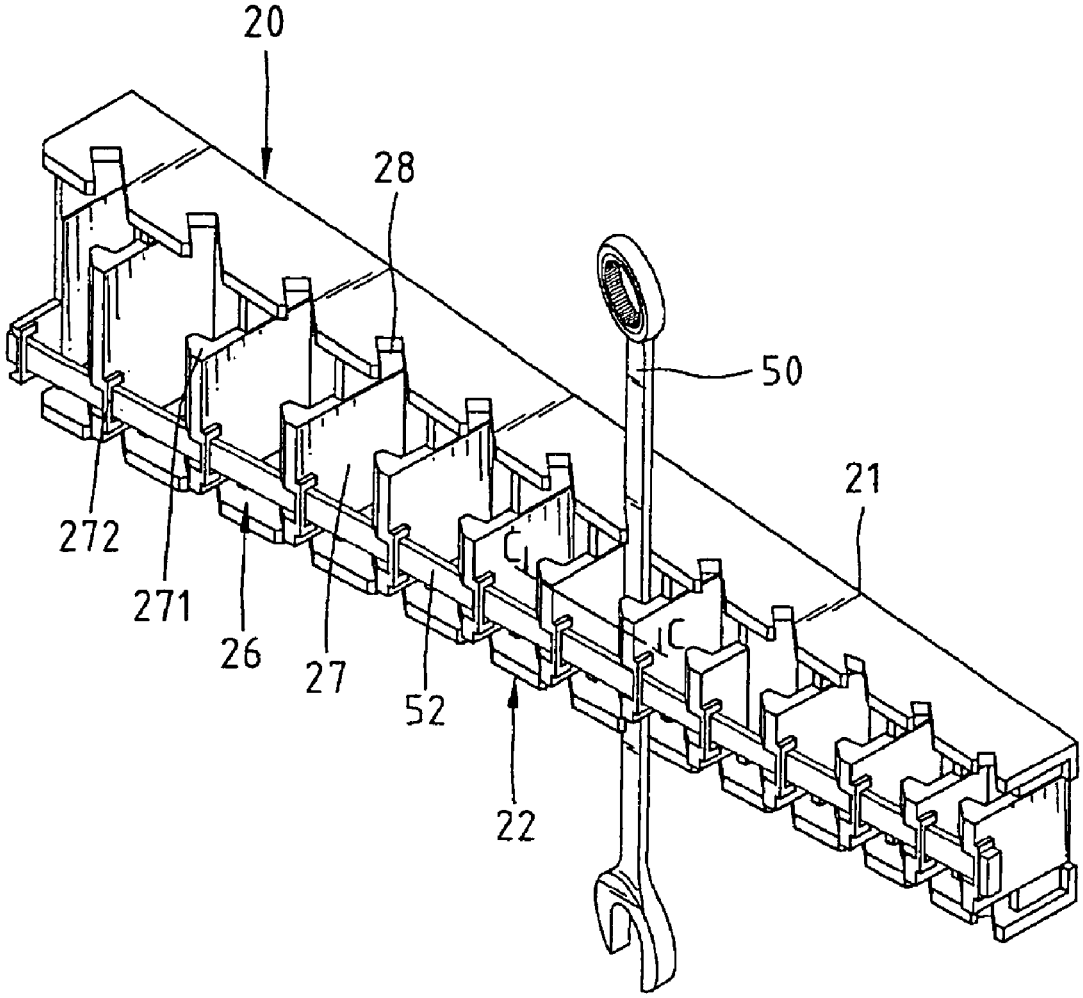
FIG. 6 is a perspective view illustrating a tool rack of the tool rack assembly in accordance with the present invention.
Figure 7:
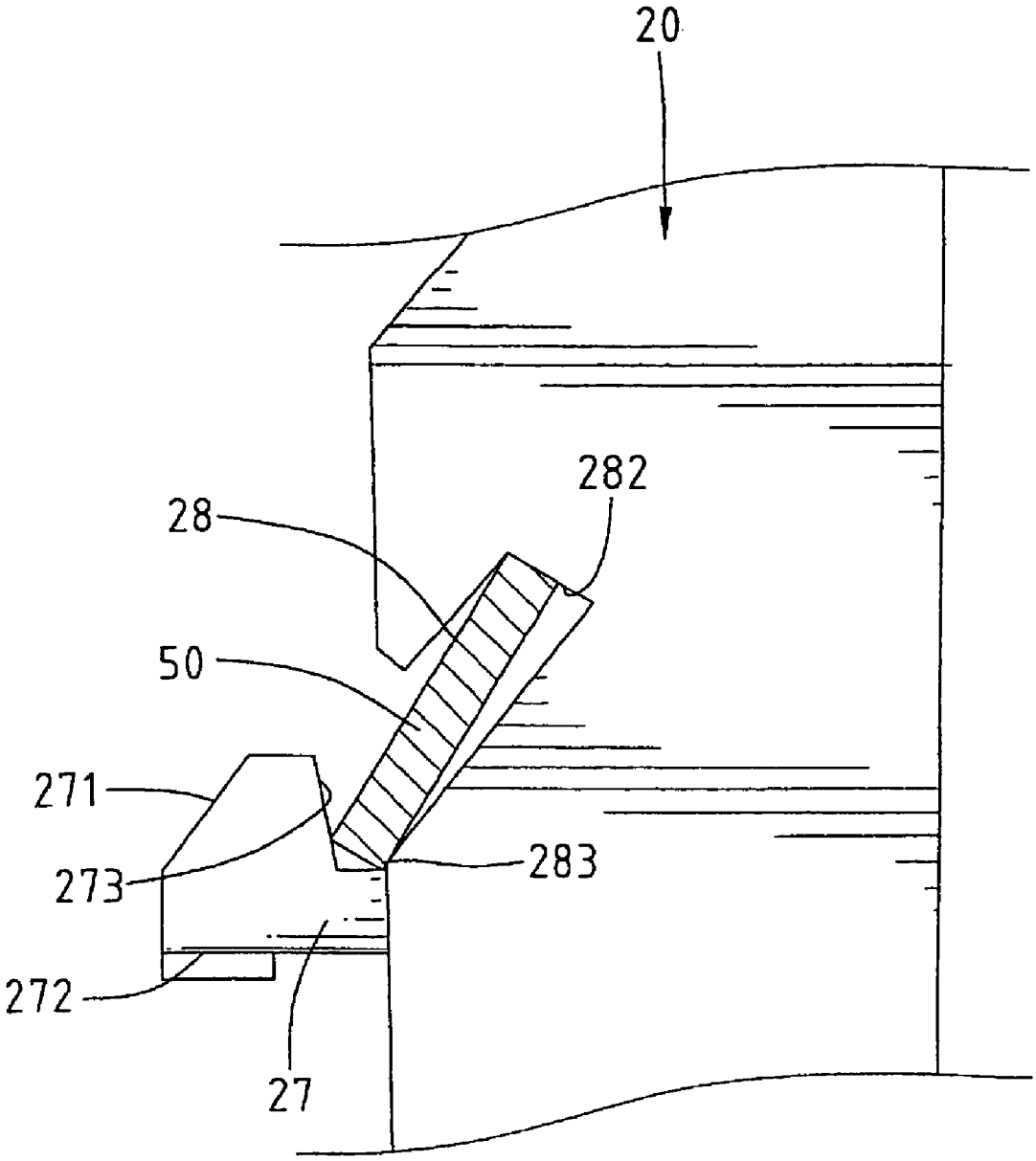
FIG. 7 is a sectional view, in an enlarged scale, taken along plane C—C in FIG. 6.

Provided on the second side 22 of the board 20 are plural tool-holding portions 26 each having a tool-holding seat 27 and a pair of vertically aligned retaining grooves 28 that extends along a direction at an angle with a longitudinal direction of the tool rack 20. Each tool-holding seat 27 includes an inclined outer guide face 271 in an outer end thereof and a locking slot 272. A tool, e.g., a combination wrench 50 (FIGS. 6 and 7) is guided into a respective pair of retaining grooves 28 by the inclined guide face 271 of a respective tool-holding seat 27 that can be slightly deformed. Namely, the combination wrench 50 slides across the respective inclined outer guide face 271 into the respective pair of retaining grooves 28 and is then securely retained in the respective pair of retaining grooves 28 by an inner retaining face 273 of the outer end of the respective tool-holding seat 27 and a corresponding face 282 and a corresponding corner 283 defining each of the respective retaining grooves 28, best shown in FIG. 7. After all of the tools 50 are retained in place, a locking strip 52 can be extended through the locking slots 272 of the tool-holding seats 27 to prevent theft, best shown in FIG. 6. Referring to FIGS. 2 and 3, the rotating means 30 comprises a fixed element 31 that is securely mounted in a hole 161 (e.g., a screw hole) of the bulge 16 of the board 10. In this embodiment, the fixed element 31 has a toothed outer periphery 311 for secure engagement with the screw hole 161 of the bulge 16. In addition, the rotating means 30 comprises a rotating member 32 having a threaded stem 321 in threading engagement with a screw hole 312 of the fixed element 31. The rotating member 32 further has a tool-engaging portion 322 in the form of a nut for engaging with an end of a tool, such as a combination wrench. A cap 33 can be engaged with a hole 323 in the tool-engaging portion 322 for preventing disengagement of the tool engaged with the tool-engaging portion 322.

Figure 8:
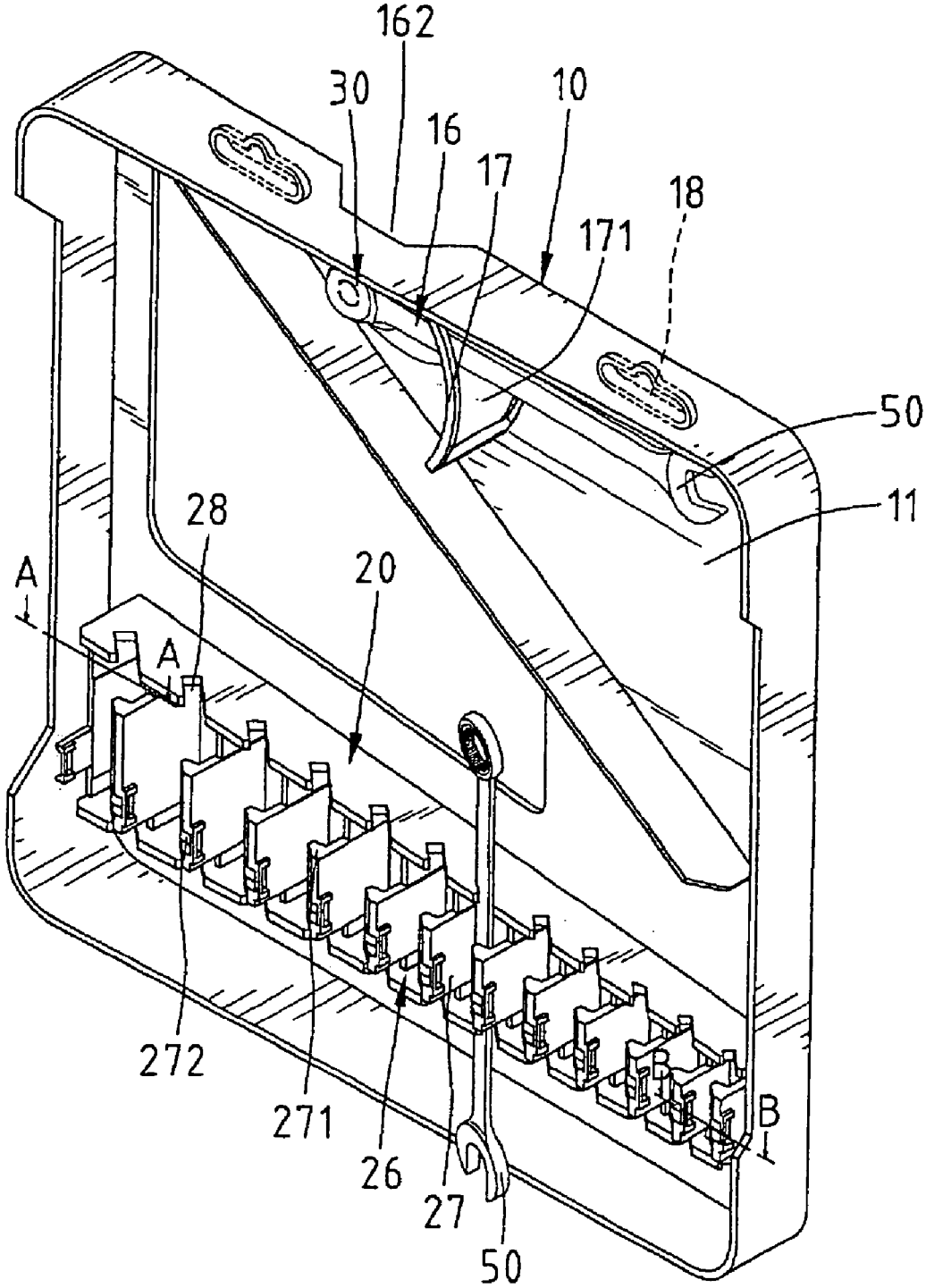
FIG. 8 is a schematic view illustrating a try-on function provided by the tool rack assembly in accordance with the present invention.

As illustrated in FIG. 8, a combination wrench 50 is extended through an opening 171 in the restraining frame 17 with an end of the combination wrench 50 engaging with the tool-engaging portion 322. Thus, one may try on the combination wrench 50 by means of normally operating the combination wrench 50. As illustrated in FIG. 3, the rotating member 32 moves along a direction transverse to a plane on which the board 10 lies, thereby imitating the tightening/loosening operation of a fastener, e.g., a nut, bolt head, etc. The recess 162 of the board 10 allows free transverse movement of the rotating member 32.

Figure 9:
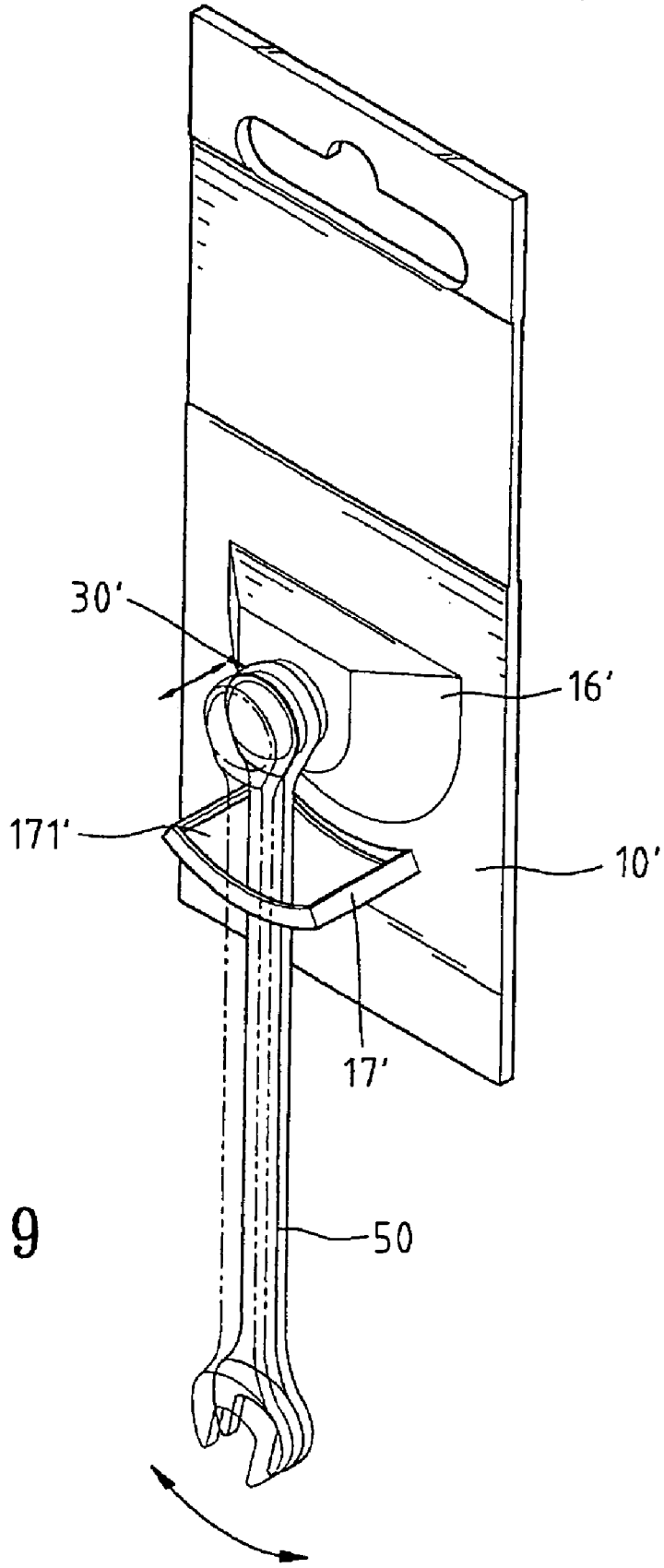
FIG. 9 is a perspective view illustrating a try-on device in accordance with the present invention.

FIG. 9 depicts a simplified try-on device in accordance with the present invention, wherein the try-on device comprises a board 10' including a bulge 16' to which the rotating means 30' is rotatably mounted for engaging with an end of a tool 50. Rotating movement of the tool 50 is restrained in an opening 171' of a restraining frame 17' that is integral with the board 10'. A recess (not shown) is defined behind the recess to allow free transverse movement of the rotating member 32.

According to the above description, the present invention provides a tool display assembly allowing a tool rack to be detachably mounted to a board. The board serves as a display device when the tool rack having tools mounted thereon is attached thereto. Thus, the user may select the required tools and place them on the tool rack, which, in turn, can be releasably attached to the board conveniently. The tool rack is tied up to the board during display, thereby preventing theft. The tool rack can be detached from the board and thus be used separately. In addition, one may try on the tool before buying it, and the operation is imitating the real operation by allowing the rotating member to move along a transverse direction during operation of the tool.

Although the invention has been explained in relation to its preferred embodiment, it is to be understood that many other possible modifications and variations can be made without departing from the scope of the invention as hereinafter claimed.

What is claimed:

1. A display for holding wrenches comprising:

a) a generally planar backboard having (i) a top edge, (ii) a bottom edge, (iii) two opposite side edges extending between said top edge and said bottom edge, and (iv) a pair of apertures defined through said generally planar backboard adjacent said top edge so that said generally planar backboard may be suspended from said apertures, wherein said top, bottom and side edges extend perpendicular to said generally planar backboard, b) a plurality of slots defined on said generally planar backboard;

c) a plurality of first elongated wrenches, each of said plurality of first elongated wrenches being received in a respective said plurality of slots so that said plurality of first elongated wrenches are generally parallel to each other and aligned transversely to a line including said pair of apertures;

d) a polygonally shaped rotating member mounted to said generally planar backboard between said top edge and said plurality of slots so that said polygonally shaped rotating member is rotatable with respect to said generally planar backboard; and e) a second wrench coupled to said polygonally shaped rotating member, wherein a side of said generally planar backboard on which said plurality of first elongated wrenches and said second wrench are disposed is uncovered so that said plurality of first elongated wrenches and said second wrench may be touched by prospective purchasers when said generally planar backboard is suspended by said pair of apertures; and wherein said plurality of first elongated wrenches and said pair of apertures are entirely within an area bounded by said top edge, said bottom edge and said two opposite side edges.

2. The display for holding wrenches of claims 1, further comprising a restraining frame through which said second wrench extends, thereby restraining pivotal movement of said second wrench between a first horizontal position and a second position.

3. The display for holding wrenches of claim 2, further comprising a transverse wall depending outwardly from said generally planar backboard, said transverse wall separating said second wrench from said plurality of first elongated wrenches.

4. The display for holding wrenches of claim 2, wherein said plurality of slots are removably attached to said generally planar backboard.

5. The display for holding wrenches of claim 2, said polygonally shaped rotating member having a hole adapted to receive a cap for engaging with said hole of said polygonally shaped rotating member to thereby prevent disengagement of said second wrench.

6. The display for holding wrenches of claim 2, wherein said polygonally shaped rotating member moves in a direction transverse to a plane on which said generally planar backboard lies when said second wrench is turned in at least one direction.

7. A display for holding wrenches comprising:

a) a generally planar backboard having (i) a top edge, (ii) a bottom edge, (iii) two opposite side edges extending between said top edge and said bottom edge, and (iv) a pair of apertures defined through said generally planar backboard adjacent said top edge so that said generally planar backboard may be suspended from said pair apertures, wherein said top, bottom and two opposite side edges extend perpendicular to said generally planar backboard, b) a plurality of slots defined on said generally planar backboard;

c) a plurality of first elongated wrenches, each of said plurality of first elongated wrenches being received in a respective said plurality of slots so that said plurality of first elongated wrenches are generally parallel to each other and aligned transversely to a line including said pair of apertures;

d) a polygonally shaped rotating member mounted to said generally planar backboard so that said polygonally shaped rotating member is rotatable with respect to said generally planar backboard; and e) a second wrench coupled to said polygonally shaped rotating member, wherein said plurality of first elongated wrenches and said pair of apertures are entirely within an area bounded by said top edge, said bottom edge and said two opposite side edges; and wherein said second wrench is rotatable between a first position parallel to said top edge and a second position.

8. The display for holding wrenches of claim 7, further comprising a restraining frame through which said second wrench extends, thereby restraining pivotal movement of said second wrench between said first and said second positions.

* * * * *